US010519619B2

(12) United States Patent
Kondas

(10) Patent No.: US 10,519,619 B2
(45) **Date of Patent: *Dec. 31, 2019**

(54) DRAIN ASSEMBLY FOR USE IN AN OUTDOOR SETTING

(71) Applicant: The American Drain Company, LLC, Apex, NC (US)

(72) Inventor: Kevin Tyler Kondas, Apex, NC (US)

(73) Assignee: The American Drain Company, LLC, Apex, NC (US)

( * ) Notice: Subject to any disclaimer, the term of this patent is extended or adjusted under 35 U.S.C. 154(b) by 15 days.

This patent is subject to a terminal disclaimer.

(21) Appl. No.: 15/367,533

(22) Filed: Dec. 2, 2016

(65) Prior Publication Data

US 2017/0081824 A1 Mar. 23, 2017

Related U.S. Application Data

(63) Continuation of application No. PCT/US2015/033854, filed on Jun. 2, 2015, which is a continuation of application No. 14/561,822, filed on Dec. 5, 2014, now Pat. No. 9,045,874.

(60) Provisional application No. 62/032,508, filed on Aug. 1, 2014, provisional application No. 62/007,399, filed on Jun. 3, 2014.

(51) Int. Cl.

| | |
|---|---|
| ***E02D 31/02*** | (2006.01) |
| ***E02D 29/00*** | (2006.01) |
| ***E03F 1/00*** | (2006.01) |

(52) U.S. Cl.

CPC ..... *E02D 31/02* (2013.01); *E02D 29/10* (2013.01); *E02D 31/025* (2013.01); *E03F 1/002* (2013.01); *E02D 2200/13* (2013.01); *E02D 2200/17* (2013.01); *E02D 2600/10* (2013.01)

(58) Field of Classification Search

CPC ..... E03F 1/002; E02D 29/10; E02D 2600/10; E02D 31/02; E02D 31/025; E02D 2200/13; E02D 2200/17; C02F 2103/001

USPC ..... 210/767, 170.03, 170.04; 52/169.5

See application file for complete search history.

(56) References Cited

U.S. PATENT DOCUMENTS

| | | | |
|---|---|---|---|
| 3,017,722 | A | 1/1962 | Smith |
| 3,761,603 | A | 9/1973 | Hays et al. |
| 3,852,925 | A | 12/1974 | Gazzo |
| 4,075,800 | A | 2/1978 | Molick |

(Continued)

FOREIGN PATENT DOCUMENTS

| | | | |
|---|---|---|---|
| JP | 0860819 | A | 3/1996 |

OTHER PUBLICATIONS

Panel Drains, www.drainaway.com/panel/last accessed Jan. 5, 2015, 3 pages.

(Continued)

*Primary Examiner* — Nam X Nguyen
*Assistant Examiner* — Julia L. Wun
(74) *Attorney, Agent, or Firm* — NK Patent Law

(57) ABSTRACT

A drain assembly for being placed inground includes a first panel and a second panel spaced-apart from the first panel, a plurality of supports extending between the first panel and the second panel, a bottom or pipe extending between a bottom portion of the first panel and the second panel, and a cap extending between a top portion of the first panel and the second panel. The first panel may define a plurality of drainage apertures. A related method is also provided.

12 Claims, 19 Drawing Sheets

(56) References Cited

U.S. PATENT DOCUMENTS

| | | | | |
|---|---|---|---|---|
| 4,103,598 | A | 8/1978 | Cooper | |
| 4,245,443 | A | 1/1981 | Beechen | |
| 4,490,072 | A | 12/1984 | Glasser | |
| 4,730,953 | A | 3/1988 | Tarko | |
| 4,843,786 | A | 7/1989 | Walkinshaw et al. | |
| 4,930,272 | A | 6/1990 | Bevilacqua | |
| 5,035,095 | A | 7/1991 | Bevilacqua | |
| 5,066,165 | A | 11/1991 | Wofford et al. | |
| 5,120,162 | A | 6/1992 | Parker | |
| 5,399,050 | A | 3/1995 | Jacobus | |
| 5,694,723 | A | 12/1997 | Parker | |
| 5,810,510 | A | 9/1998 | Urriola | |
| 5,836,716 | A * | 11/1998 | Johnson | E02B 11/005 405/43 |
| 6,027,283 | A * | 2/2000 | Schweinberg | E01C 11/227 404/4 |
| 6,595,720 | B2 | 7/2003 | Humphries et al. | |
| 6,648,549 | B1 | 11/2003 | Urriola | |
| 6,672,016 | B2 | 1/2004 | Janesky | |
| 6,986,621 | B2 | 1/2006 | Allard | |
| 7,132,045 | B1 | 11/2006 | Trangsrud | |
| 7,413,372 | B2 * | 8/2008 | Meyers | E03F 3/046 404/2 |
| 7,690,857 | B2 | 4/2010 | Key | |
| 7,810,291 | B2 | 10/2010 | McPherson | |
| 8,555,586 | B2 * | 10/2013 | Lowe | E03F 1/005 210/170.03 |
| 2003/0200708 | A1 | 10/2003 | Parker | |
| 2006/0096186 | A1 * | 5/2006 | Safie | E02D 29/0258 52/169.5 |
| 2013/0180929 | A1 | 7/2013 | Kowalsky et al. | |

OTHER PUBLICATIONS

Multi-Flow, www.landscapedrainagesolutions.com/id110.html, last accessed Jan. 5, 2015, 3 pages.

Megaflow, geotas.com/media/products_top/drainage/PDF/Megaflow%20brochure%20M010%2009-09.pdf, last accessed Jan. 5, 2015, 5 pages.

Megaflow, www.autospec.co.za/productmedia/kaytech/brochure-downloads/index-megaflow.html, last accessed Jan. 5, 2015, 4 pages.

ProTank Modular Tanking System, www.globalsynthetics.com.au/products.php?id=8, last accessed Jan. 5, 2015, 2 pages.

Form-a-Drain, www.naspecialityproducts.com/Public/Products/Foundation-Building-Products/Form-A-Drain-23.html, last accessed Jan. 5, 2015, 1 page.

Drain the Rain, www.sportsfieldmanagementmagainze.com/content/SM2013/04/A9342_2 full.jpg, last accessed Jan. 5, 2015, 1 page.

Trench Drains, www.americanwick.com/applications/detail.cfm?app_id_52, last accessed Jan. 5, 2015, 2 pages.

Trench/Edge Drain, www.americanwick.com/uploads/documents/TRENCH-EDGE%20DRAIN.2009.pdf, last accessed Jan. 5, 2015, 1 page.

Geotextile & Impermeable Liner; www.rainsmartsolutions.com/horizontal_vertical_drainage.html#b, last accessed Jan. 5, 2015, 2 pages.

Horizontal/Vertical Wall Drainage System: www.rainsmartsolutions.com/geotextile_&_impermeable_liner.ltml, last accessed Jan. 5, 2015, 3 pages.

NDS Dura Slope Trench Drain System 6" x 4'0" DS-098, www.nuwayinc.com/ProductDetail.aspx?prdid=4845, last accessed Jan. 5, 2015, 2 pages.

Dura Slope, www. ndspro.com/images/stories/pdfs/trench-drain/dura-slope-trench-drain-system-tsg.pdf, last accessed Jan. 5, 2015, 15 pages.

Zurn Perma-Trench HDPE System, www zuntrenchdrain.com/perma-trench-hdpe.html, last accessed Jan. 5, 2015, 2 pages.

EnviroChannel, www.pds-pic.com/clickyzine/envorochannel/pdf/Envirochannel.pdf last accessed Jan. 5, 2015, 12 pages.

Membrane Drain, www. acodrain.us/membranedrain.html, last accessed Jan. 5, 2015, 1 page.

FlowDrain, www.acodrain.us/flowdrain.html, last accessed Jan. 5, 2014, 4 pages.

USPTO, Non-Final Rejection in U.S. Appl. No. 14/561,822 dated Mar. 2, 2015.

USPTO, Notice of Allowance in U.S. Appl. No. 14/561,822 dated Apr. 22, 2015.

PCT, International Sear Report and Written Opinion for International Application No. PCT/US15/33854 dated Nov. 13, 2015.

* cited by examiner

Fig. 9
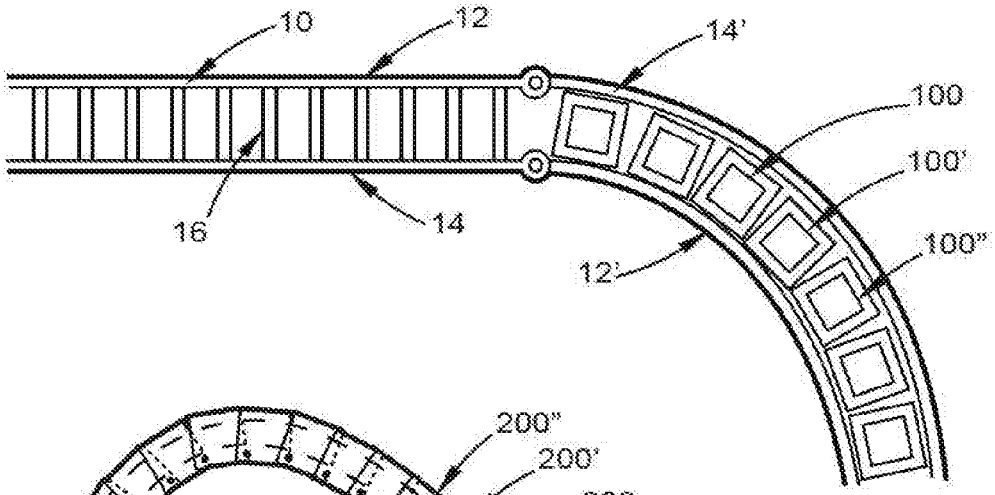
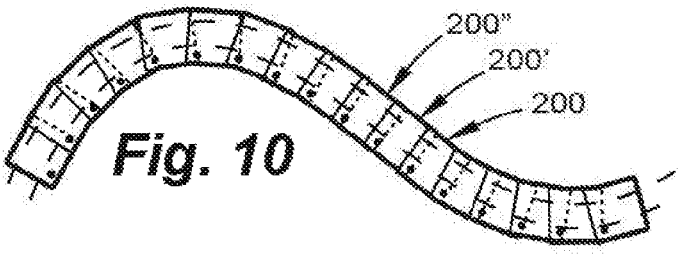
Fig. 10
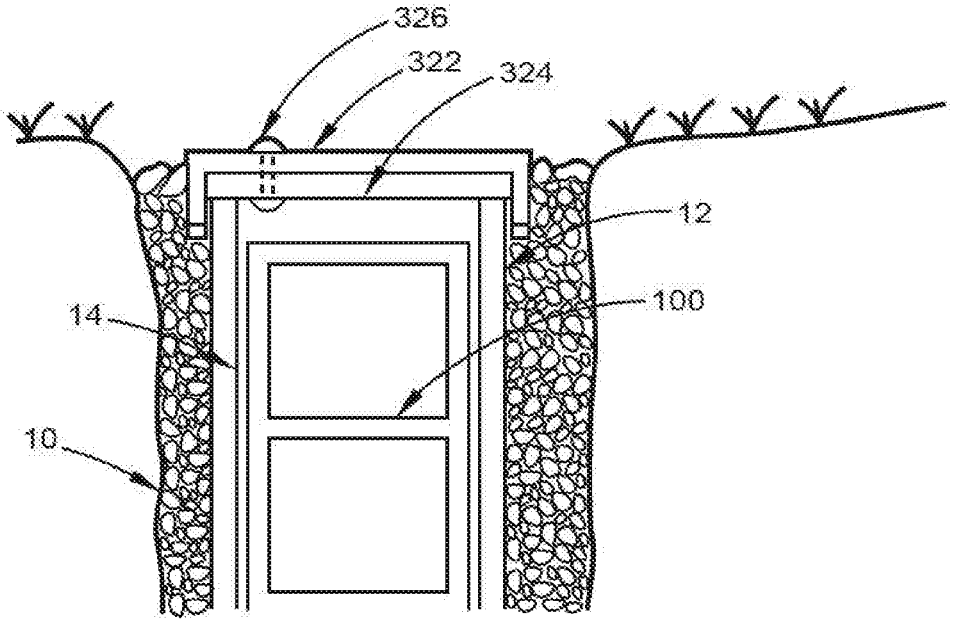
Fig. 11

DRAIN ASSEMBLY FOR USE IN AN OUTDOOR SETTING

CROSS-REFERENCE TO RELATED APPLICATIONS

This application is a continuation of PCT Patent Application No. PCT/US15/33854 filed on Jun. 2, 2015 and entitled DRAIN ASSEMBLY FOR USE IN AN OUTDOOR SETTING, which is a continuation of U.S. patent application Ser. No. 14/561,822 filed on Dec. 5, 2014 and entitled DRAIN ASSEMBLY FOR USE IN AN OUTDOOR SETTING, which claims priority to U.S. Provisional Patent Application No. 62/007,399 filed on Jun. 3, 2014 and entitled DRAIN ASSEMBLY FOR USE IN AN OUTDOOR SETTING, and U.S. Provisional Patent Application No. 62/032,508 filed on Aug. 1, 2014 and entitled DRAIN ASSEMBLY FOR USE IN AN OUTDOOR SETTING, the contents of which are hereby incorporated by reference herein.

TECHNICAL FIELD

This application is directed towards a drain assembly for use in an outdoor setting, and, more particularly, towards a drain assembly for use as an easy to inspect, test, clean and maintain alternative to French drains and for use with other water management settings and situations.

BACKGROUND

French Drains are used by many landscapers and builders as a method to collect standing water and run-off, as well as underground water from lawns and fields or near foundations to move the water to a more desirable area. French drains can also be used as a method for dispersing and filtering water on-site through soil, as with septic systems.

French drains are also used to capture run-off and prevent soil erosion. French drains are commonly constructed in a trench with perforated pipe lying along the trench bottom. The perforated pipe is surrounded by gravel, styro-foam nuggets or poly-stone with or without fabric filter material lining the trench and/or encasing all or parts of the system.

Air spaces and voids between stones fill in with soil due to soiled water flowing into them over time. The pipes can also collapse, fill with roots and sediment and can become clogged over time, sometimes within one or two years. Foundation drains clog often without the home owner's knowledge and cause a host of foundation problems including uneven settling, cracking, water damage, and the like. The gravel provides air space to allow the water to pass through into the pipe to be carried away or out of the pipe to leach into the soil. The filtering gravel and pipe eventually become clogged due to the muddy, dirty water, roots, and sewage solids that seeps into or out of them. Checking the French drain gravel for clogging or a low flow situation is difficult without digging up the gravel and sometimes the drain. The gravel is then replaced or cleaned and reinstalled, yet further clogging of the drain is likely.

Accordingly, a product or method for addressing these issues is desired.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Disclosed herein is a drain assembly for being placed underground. The assembly includes a first panel and a second panel spaced-apart from the first panel, a plurality of supports extending between the first panel and the second panel with or without a bottom extending between a bottom portion of the first panel and the second panel, and a cap extending between a top portion of the first panel and the second panel. The first panel defines a plurality of drainage apertures. In one or more other embodiments, the panel can include notches at a bottom portion or other desired area.

According to one or more embodiments, the plurality of supports include one or more spacers or pins extending from an inner surface of the first panel to an inner surface of the second panel.

According to one or more embodiments, the bottom defines one of a basin for directing channeled liquid flow or a pipe receiving area for receiving a pipe for directing channeled liquid flow or a gravel bottom may be desired.

According to one or more embodiments, respective ends of the first panel and the second panel are configured for pivoting movement to engage a respective second drain assembly thereto. The ends may have accompanying fittings or couplings.

According to one or more embodiments, the cap is selectively engageable with the first and second panel.

According to one or more embodiments, a second assembly may be positioned into engagement with a top portion of the first panel and the second panel when the cap is selectively disengaged. These assemblies may be stacked horizontally or connected vertically.

According to one or more embodiments, the apparatus includes a filter material positioned between the first panel and the second panel.

According to one or more embodiments, the second panel is water impermeable.

According to one or more embodiments, the assembly is configured for being in fluid engagement with a downspout of a gutter system.

According to one or more embodiments, the assembly includes one of a water level sensor, moisture sensor, or temperature sensor positioned between the first panel and the second panel. A fan may also be provided for blowing or pulling air.

In one or more embodiments, the assembly may act as a conduit for passing liquid, air, heated air, cooled air, and the like.

According to one or more embodiments, the assembly includes a locator wire.

According to one or more embodiments, a method for providing drainage to an area is provided. The method includes providing a drain assembly disclosed herein, placing the assembly into the void, and filling the volume of the void outside of the drain assembly.

According to one or more embodiments, the method includes providing a filter fabric around the exterior of the assembly before filling the volume.

According to one or more embodiments, the method includes attaching a second assembly to an end of the first assembly to create a length of attached assemblies.

According to one or more embodiments, the method includes attaching a second assembly to a top of the first assembly to create a height of attached assemblies.

According to one or more embodiments, the method includes placing a drainage pipe in the bottom of the assembly.

BRIEF DESCRIPTION OF THE DRAWINGS

The foregoing summary, as well as the following detailed description of various embodiments, is better understood when read in conjunction with the appended drawings. For the purposes of illustration, there is shown in the drawings exemplary embodiments; however, the presently disclosed subject matter is not limited to the specific methods and instrumentalities disclosed. In the drawings:

FIG. 9 illustrates a top view of a drain assembly according to one or more embodiments disclosed herein;

FIG. 10 illustrates a top view of a curvable assembly top cap assembly according to one or more embodiments disclosed herein;

FIG. 11 illustrates a front view of a drain assembly with a pivoting cap according to one or more embodiments disclosed herein;

FIGS. 22A and 22B illustrate alternate embodiments of a drain assembly according to.

DETAILED DESCRIPTION

The presently disclosed subject matter is described with specificity to meet statutory requirements. However, the description itself is not intended to limit the scope of this patent. Rather, the inventor has contemplated that the claimed subject matter might also be embodied in other ways, to include different steps or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

Figure 1:
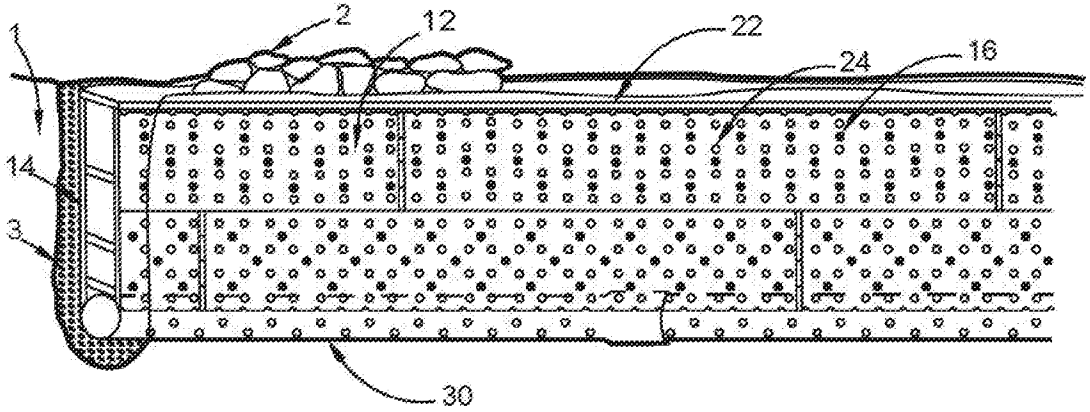
FIG. 1 illustrates a side-facing perspective view of a drain assembly according to one or more embodiments disclosed herein.

FIG. 1 illustrates a perspective view of a drain assembly that is generally designated 10 and that is configured for being placed underground 1 within a void 3. The drain assembly 10 may include a first panel 12 and a second panel 14 spaced-apart from the first panel 12. A plurality of supports 16 may extend between the first panel 12 and the second panel 14. With additional reference to FIG. 3, a bottom 20 may extend between a bottom portion of the first panel 12 and a bottom portion of the second panel 14. A cap 22 may extend between a top portion of the first panel 12 and a top portion of the second panel 14. One or more of the panels 12, 14 may define a plurality of drainage apertures 24.

Panels without any holes, apertures, or other openings may be used. In this embodiment, water can enter through apertures in the cap but roots or other debris cannot enter the drain panel system. This aspect can sit on top of any pipe to convert a pipe into a surface drain without obstructing water flow inside of the pipe line (as with a basin drain where installation may require cutting into the pipe to install the basin or may require a fitting/fittings to tie the basin in to the system). A drain can be added to an existing pipe system by digging away or otherwise removing dirt from around an existing pipe, drilling holes into the top of the pipe, and installing panels of appropriate height on top of the pipe then backfilling around the panels so the perforated cap is positioned in a low area of a property to receive water.

The panels may be flexible in nature such that the panel/panels can be flared out at a bottom portion thereof. The panels may also fully or partially encapsulate any pipe. This allows for a pipe with holes/apertures drilled all the way around the pipe to be protected, maintained and inspected inside the medial space. The panels may also be formed in part with trifluralin.

The assembly 10 is illustrated being installed within void 3 that is defined within the underground 1. The void 3 may be formed by any appropriate manner of excavation and may be positioned proximal a structure such as a residential or commercial building or in a drainage field or any other appropriate place. In the one or more instances where the void 3 may be placed near a structure, only one of panels 12, 14 may be provided with drainage apertures 24 such that the other panel remains water impermeable. For example, panel 14 may be closely spaced with the building and generally impermeable whereas panel 12 may be permeable. Rocks, a decorative cap, or other fill material 2 may be employed for covering assembly 10 once installed. Panels 12, 14 may be formed of any appropriately configured material, including a polymer such as polyvinyl chloride or other plastics, resins, and the like. While apertures 24 are illustrated in the drawings as generally circular voids, apertures 24 may be slots or other configurations, or may alternatively be semi-porous and porous structures. Panels 12, 14 could employ a porous material to allow flowthrough of liquid in desired embodiments.

The plurality of supports 16 may include one or more pins extending from an inner surface of the first panel 12 to an inner surface of the second panel 14. The supports 16 may include any appropriately configured spacer of any appropriately configured shape. Alternatively, panels 12, 14 or the assembly 10 may have enough rigidity that supports 16 are not required in one or more embodiments.

Figure 5:
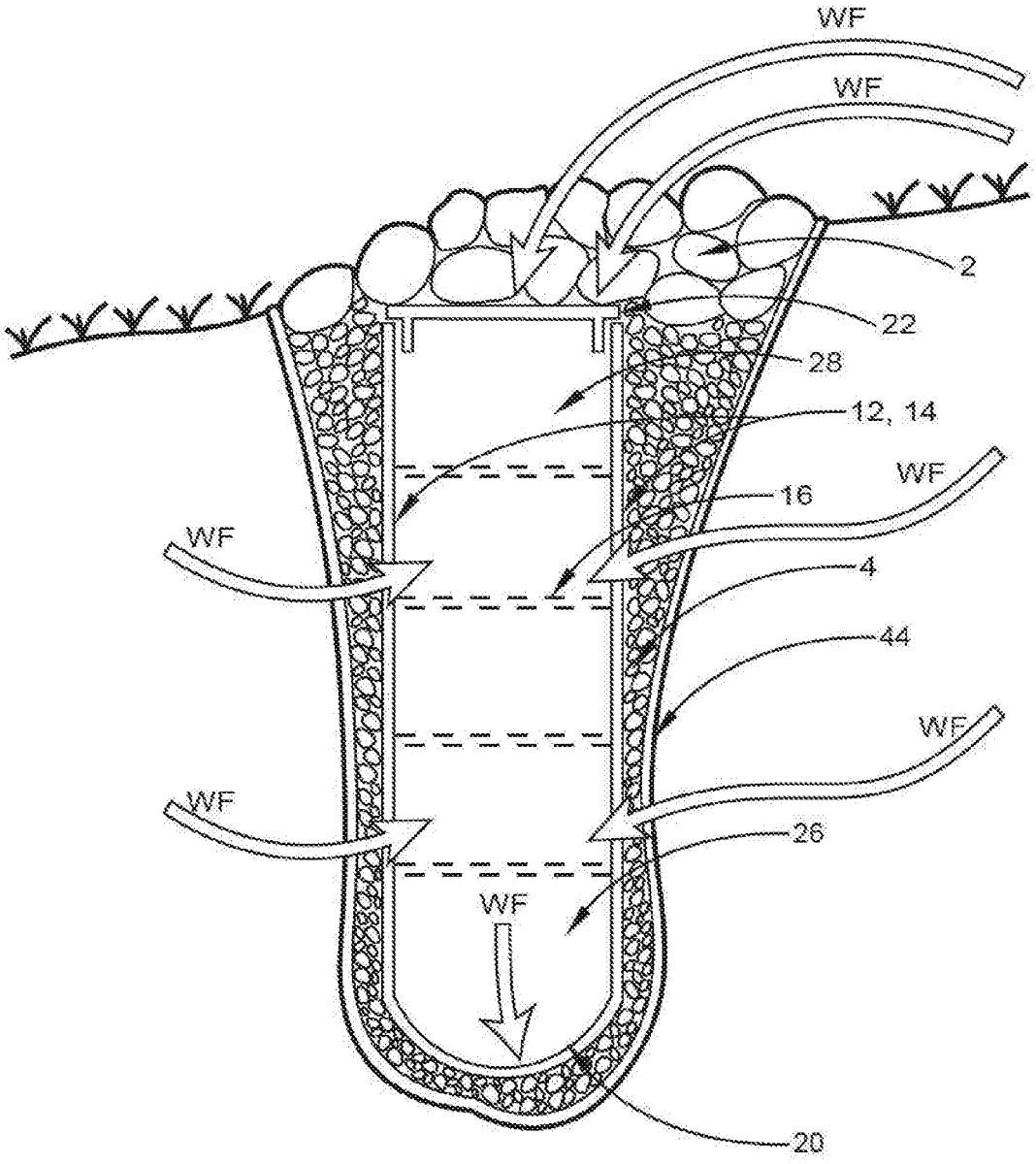
FIG. 5 illustrates a front view of a drain assembly according to one or more embodiments disclosed herein.

The bottom 20 defines one of a basin 26 (FIG. 5) for directing channeled liquid flow or a pipe receiving area for receiving a pipe 30 (FIG. 3) for directing channeled liquid flow. Pipe 30 may have one or more apertures for collecting water in the void between panels 12 and 14. Pipe 30 may also have no apertures in one or more embodiments. Pipe 30 may also be fluidly connected to a gutter downspout assembly, an additional drain assembly such as a French drain, an irrigation system, or the like. Alternatively, the bottom 20 may be exposed to an underlying ground surface such that collected liquid can permeate into the underlying ground surface.

Figure 2:
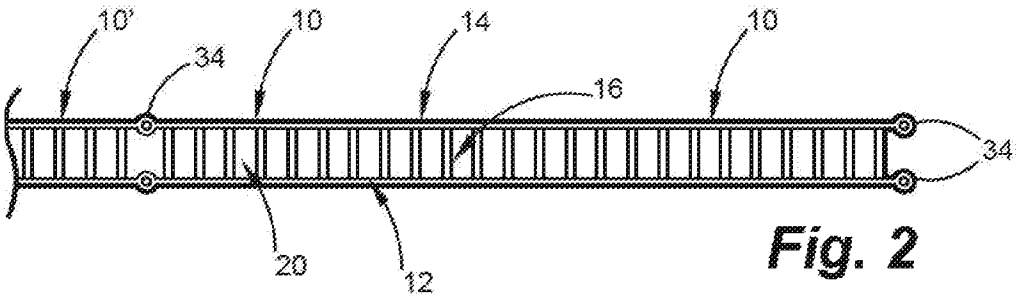
FIG. 2 illustrates a top view of a drain assembly without a cap according to one or more embodiments disclosed herein.
Figure 8:
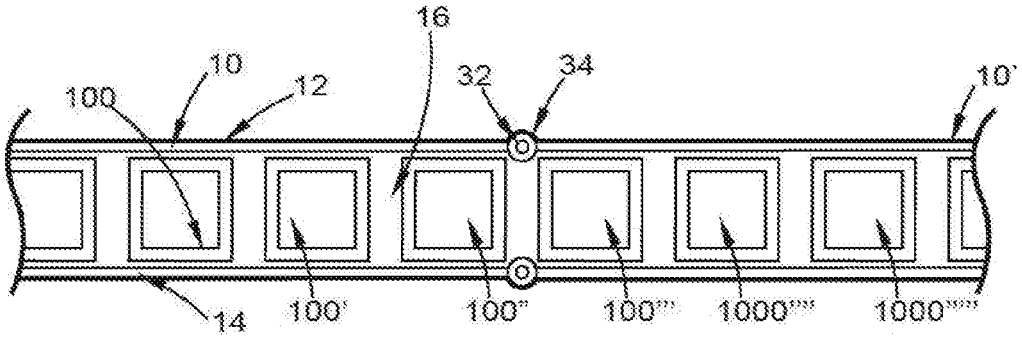
FIG. 8 illustrates a top view of the support of FIG. 7 installed within a drain assembly according to one or more embodiments disclosed herein.

As illustrated in FIG. 2 and FIG. 8, in one or more embodiments, respective ends of the first panel 12 and the second panel 14 are configured for engaging a respective second drain assembly 10' thereto. This engagement may include a receiver 34 and a pin 32 for interconnecting respecting assemblies. In this manner, multiple assemblies can be formed lengthwise. Alternatively, respective and adjacent assemblies could also be joined in other manners, such as glue, welding, fasteners, and the like. Snapping together of assemblies may also be provided.

Figure 6:
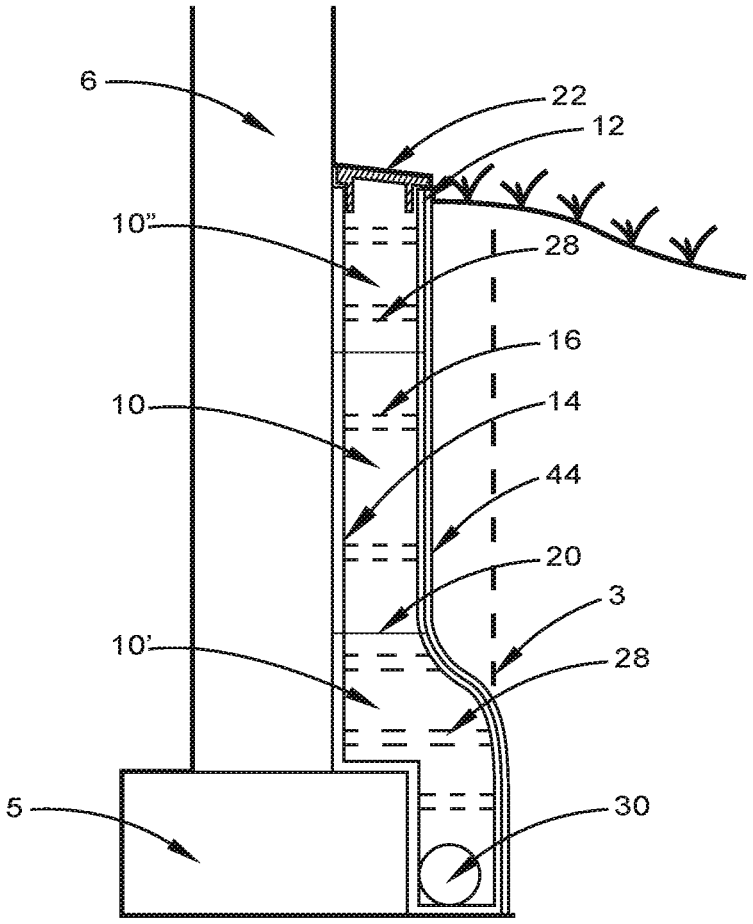
FIG. 6 illustrates a front view of a drain assembly according to one or more embodiments disclosed herein.

The cap 22 is selectively engageable, meaning separable, with the first panel 12 and the second panel 14. The cap 22 may be selectively disengaged with assembly 10, and a second assembly 10' may be positioned into engagement with a top portion of the first panel 12 and the second panel 14 as illustrated in FIG. 6. The cap 22 may be a porous material or an impermeable material. The cap 22 may define a portion of porous material that grass or other vegetation could grow into and/or over the top of. Additionally, an end cap (not illustrated) could be provided for encapsulating the end of an assembly 10.

Figure 3:
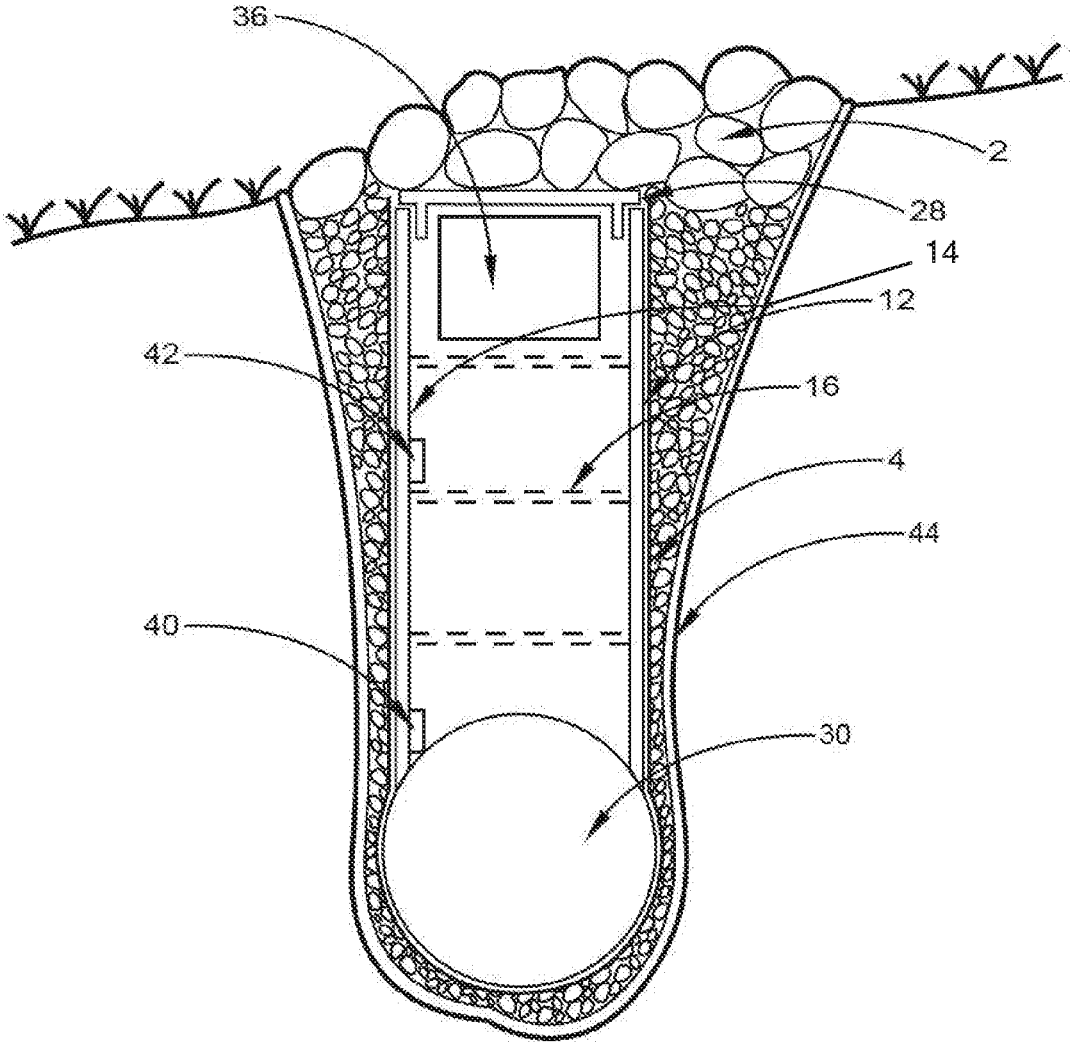
FIG. 3 illustrates a front view of a drain assembly according to one or more embodiments disclosed herein.

As one illustrative embodiment, a filter material 36 is illustrated in FIG. 3 and is positioned directly below the top cap for easy removal or in the drain line vertically between the first panel 12 and the second panel 14. The filter material 36 may be provided for filtering water or other liquids before they pass into drainage pipe 30. Filter material 36 and/or insulation material may be used to insulate the drainage void to keep the foundation from freezing as well as the geothermal factor. In one or more embodiments, a sensor 40 may be provided. The sensor 40 may be positioned between the first panel 12 and the second panel 14 in one or more embodiments. The sensor 40 may be configured for providing selective determination of the water level, moisture, or temperature within the assembly 10 and may be configured to communicate a level reading to one or more monitoring systems. In this manner, the sensor 40 may be a water level sensor, a moisture or humidity sensor, or a temperature sensor. In one or more embodiments, a locator wire 42 or other metallic/ferrous material may be provided along a length of the assembly 10 in order to help locate the assembly 10 underground at a later time when digging, excavating, or the like may be desired. A fan may also be provided within the spacing for pushing or pulling air through the assembly. Alternatively, cap 22 may be ferrous so as to provide the locating characteristics of the locating wire and may be removable.

Figure 4:
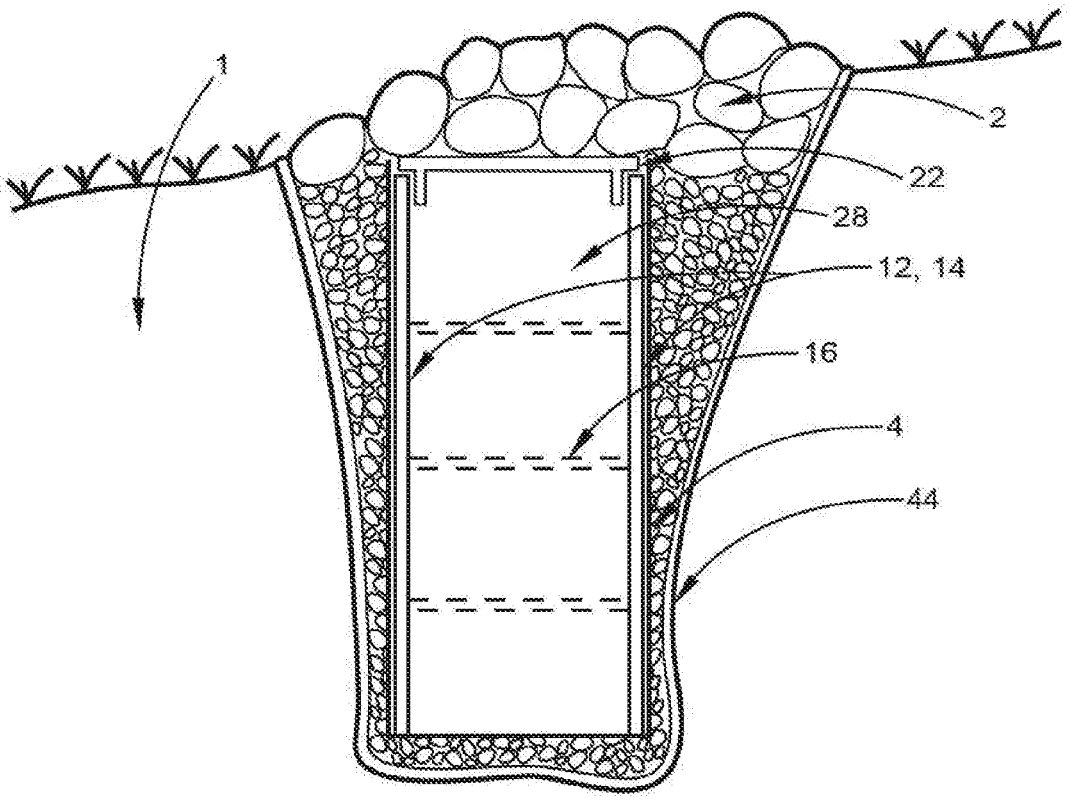
FIG. 4 illustrates a front view of a drain assembly according to one or more embodiments disclosed herein.
Figure 12:
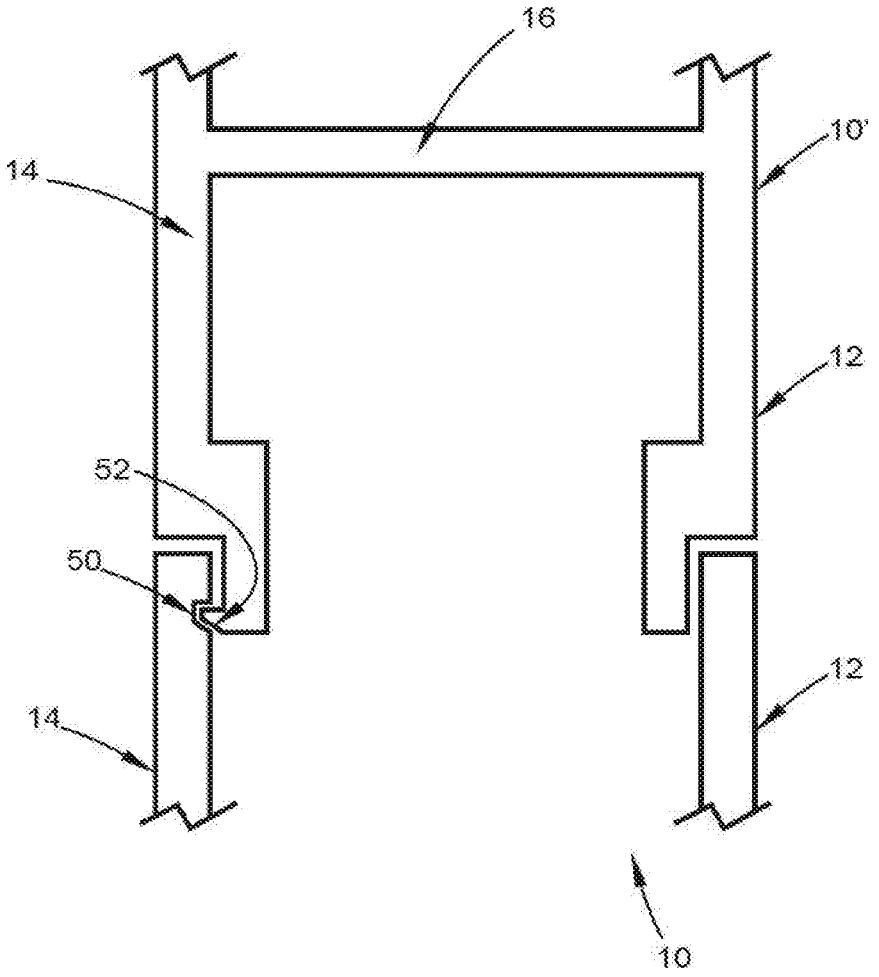
FIG. 12 illustrates a partial, front view of an upper to lower drain assembly connection according to one or more embodiments disclosed herein.

The assembly 10 may come as a kit in which unassembled panels 12, 14, supports 16, caps 22, and the like are provided. In this manner, an installer can choose a panel of a desired size, a support of a desired size, and the like to produce an assembled unit of desired size and geometry. The panels 12, 14 may be shaped to size by the operator and may be configured for being cut by a saw, knife, or the like. One such embodiment is shown in FIG. 6 in which a first assembly 10 is shown having the same general construction as that one shown in FIG. 4, whereas assembly 10' is shown being formed for fitting around a footer 5 of a house. Masonry wall or foundation wall is represented by element 6. Assembly 10" is shown having a shorter height than assembly 10, and this may be as a result of the operator cutting panels 12, 14 to a shorter length, which may require new end-to-end connectors or top panel to bottom panel connectors. Furthermore, assembly 10" is shown with an angled cap 22 that is caused by the inner panel being a greater height than the outer panel. Alternatively, the cap 22 may define a top angled surface for channeling water. Thus, the angled cap 22 also provides for water drainage. In order to connect height-wise multiple assemblies, a hook 52 may extend from the bottom portion of an assembly 10' and is received within a recess 50 formed on a top portion of an adjacent assembly 10. Alternatively, an "H" channel connector system may be employed. In FIG. 12, the hook may or may not be necessary on one or both or either side.

The spacers may be pre-made tapered spacers (such as having an hourglass shape) that can be used to achieve the spaced-apart relationship.

Figure 17:
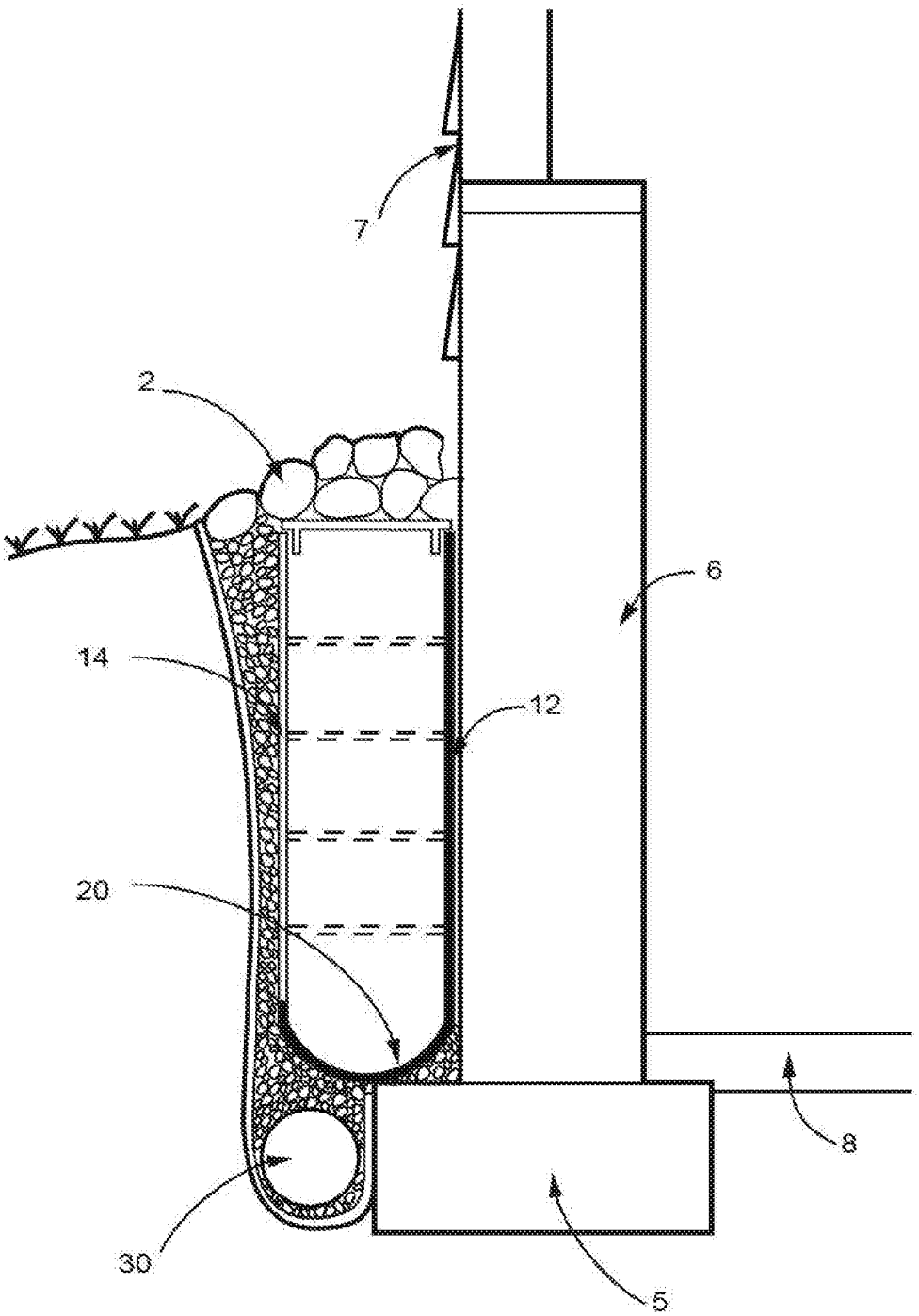
FIG. 17 is a view of an apparatus and system according to one or more embodiments disclosed herein.

With further reference to FIG. 17, wall 7 of the house is illustrated and floor 8 is also illustrated, which may be a basement subfloor or any other subfloor that is also provided. In the embodiment illustrated in FIG. 17, assembly 1700 includes wall 12, which is impermeable along with bottom 20. Collectively, wall 12 and bottom 20 form a "J" shaped impermeable panel.

Figure 7:
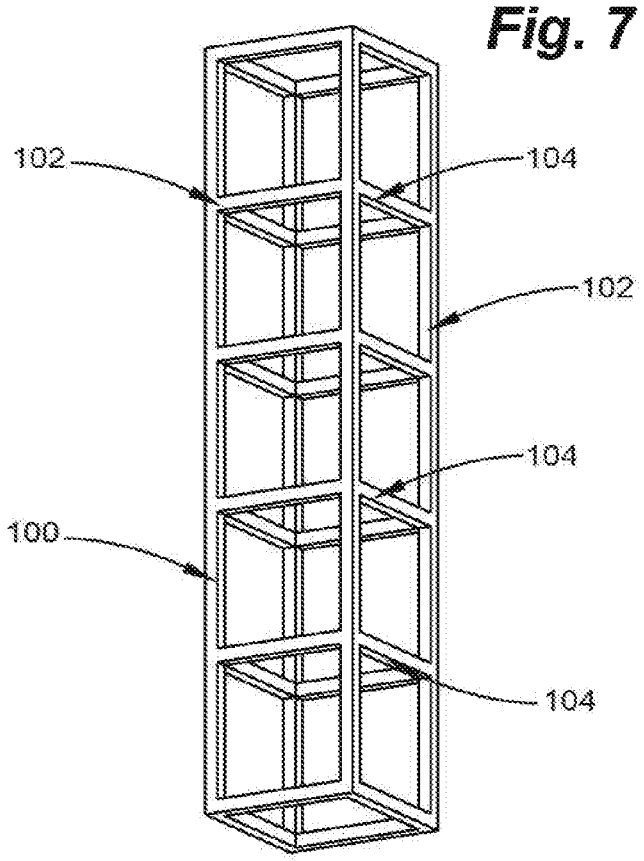
FIG. 7 illustrates a perspective view of a support for use with a drain assembly according to one or more embodiments disclosed herein.

An alternate construction is illustrated in FIG. 7 and FIG. 8 in which an assembly 100 is provided. The assembly 100 may include one or more longitudinal supports 102 and cross bars 104 that form the frame assembly. The assembly 100 is configured for being placed into a void in an upright orientation (such as is shown in FIG. 7) or into the void of drain assembly 10. In this matter, the assembly 100 provides a means of allowing panels to be bent around curves or a radius, then inserting bracing as shown in FIG. 7. Panels 12 and 14 may thus be bent or otherwise curved. One side panel such as 1814 can also be used with a flat panel to create curves.

Similarly, assembly 100, 100', and 100" are illustrated in a curved panel 12', 14' construction in FIG. 9. The curved panels 12' and 14' are connected with assembly 10 to form one elongate structure.

As illustrated in FIG. 10, curvable top cap assemblies 200, 200', and 200" may be formed such that an entire structure of curvable assemblies can be formed. As illustrated in FIG. 11, an alternate cap assembly 322 may be provided where the cap assembly 322 is also resilient to allow for curving characteristics of the assembly shown in FIG. 10. In this manner, the side panels may be curvable and supports 100, 100', 100", etc are placed within the curvable panels to provide sufficient support while also allowing for curvature of the assembled device. This illustration is an example of the curvable top-cap assembly.

FIG. 11 illustrates an end view of a drain assembly 10 having a removable top cap 322, that is also part of FIG. 10, that is attached to a permeable cap 324 extending across panels 12 and 14. In this embodiment, support 100 is shown between panels 12 and 14. The cap 322 is attached to permeable cap 324 by a fastener 326 or any other appropriate attachment mechanism. In this manner, when the panels 12 and 14 have been placed into the ground, support 100 is inserted and then the cap 322 is affixed to cover the assembly 100. Cap 322 may be permeable, impermeable, include aesthetic or ornamental features as described with other embodiments disclosed herein.

Figure 13:
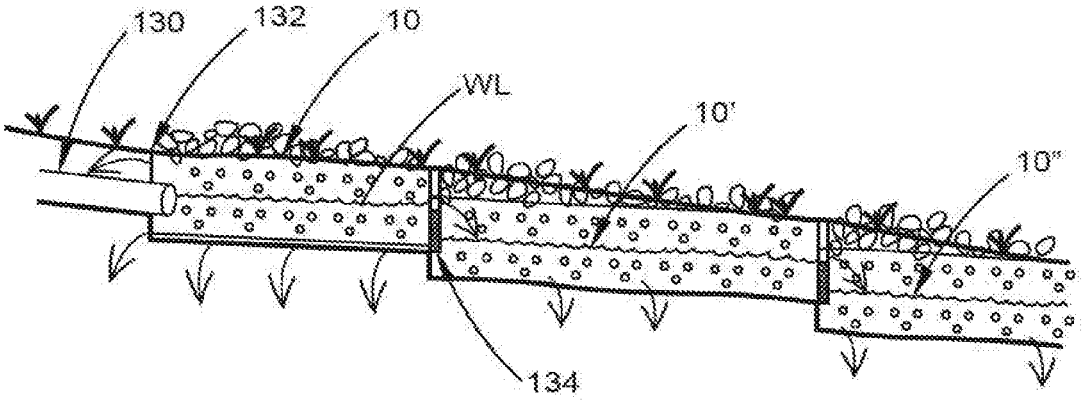
FIG. 13 illustrates a series of interconnected drain assemblies installed along a sloping terrain for use in discharging collected water along a path.
Figure 14:
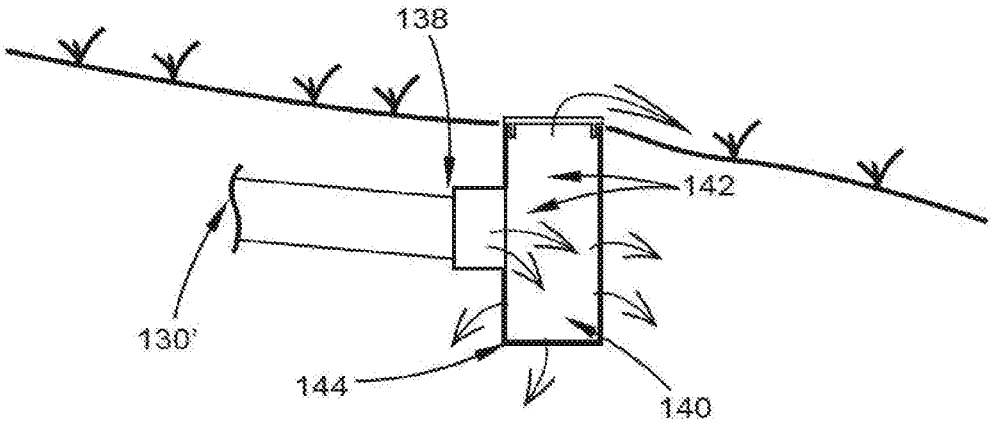
FIG. 14 illustrates a pipe entering into the side of a length of drain assemblies.

FIG. 13 illustrates a plurality of drain assemblies 10, 10', and 10" that are interconnected and formed along a slope of land. The drain assemblies are provided in step-down arrangement such that when the water level WL in a respective drain assembly 10 rises enough to exceed an end 134 of the assembly, water can flow into the next assembly 10'. In this manner, the end cap 134 of assembly 10 is water impermeable. This arrangement allows for liquid to flow out of the bottom of the assembly 10 in a slower rate and can allow for more even dispersement of liquids on a person's property, for example, as opposed to the majority of liquid dispersing only at the end of a drain pipe. This provides irrigation benefits and structural benefits since soils will not become water-logged as well as filtering water through soil. The end assembly 140 and outlet tee coupling 138 extending from pipe 130' as illustrated in FIG. 14 may extend from any drain assembly described herein. End assembly 140 may include one or more drainage apertures and an open bottom 144 for allowing flow-through of water into the surrounding ground surface.

Figure 15:
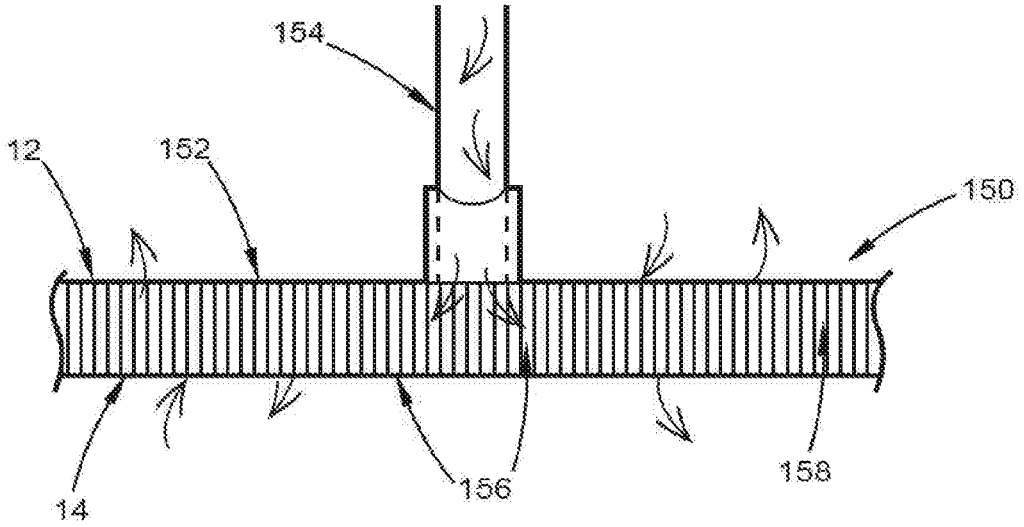
FIG. 15 illustrates a top view of one or more embodiments of a drain assembly illustrated in FIG. 14.

FIG. 15 illustrates a top view of one or more connected assemblies 10, 150 for use with the drain assemblies 10 described herein. Indeed, a grated top cap 152 may replace top cap 22 in one or more embodiments. A connector pipe/drain pipe 154 can connect with the assembly 150 from a side into a coupler 156, which is further coupled to a drainage assembly 150 or drain assembly 10. This embodiment is illustrated to show that an assembly 10 may be used as a drain pipe discharge location. An end cap may also be provided.

One or more methods of using the one or more drainage assemblies disclosed herein are provided. The one or more methods include forming a void in the ground. The void may be formed by excavation or the like. The void depth may be determined by selecting a drain assembly 10 of a certain height, and then forming a void having a depth that is of a predetermined height larger than the certain height. The method may include placing the assembly into the void. Void may be void 1 as illustrated in FIG. 1. The remaining volume of the void may be filled with one or more materials. The one or more materials may include a homogenous mixture of soil, rocks of various granularities, and the like, or may include a heterogeneous mixture of the same or layers of various materials.

In one or more embodiments, the method may include providing a filter fabric 44 or other root inhibitor around the exterior of the assembly before filling the volume. The filter fabric may be positioned against the assembly or against the void. The filter fabric may be provided for filtering out sediment and the like. The root inhibitor could also be built into panels.

In one or more embodiments, the method may include attaching a second assembly to an end of the first assembly to create a length of attached assemblies. The method may include attaching additional assemblies as desired. This method may include attaching a second assembly to a top of the first assembly to create a height of attached assemblies. In instances where a drainage pipe such as pipe 30 is placed within the assembly, the method may include attaching respective drainage pipes in a respective assembly to form a length of fluidly connected pipes.

The one or more assemblies and systems disclosed herein may also have use as an add on for septic field use or as a replacement for French drain components in septic fields.

Figure 16:
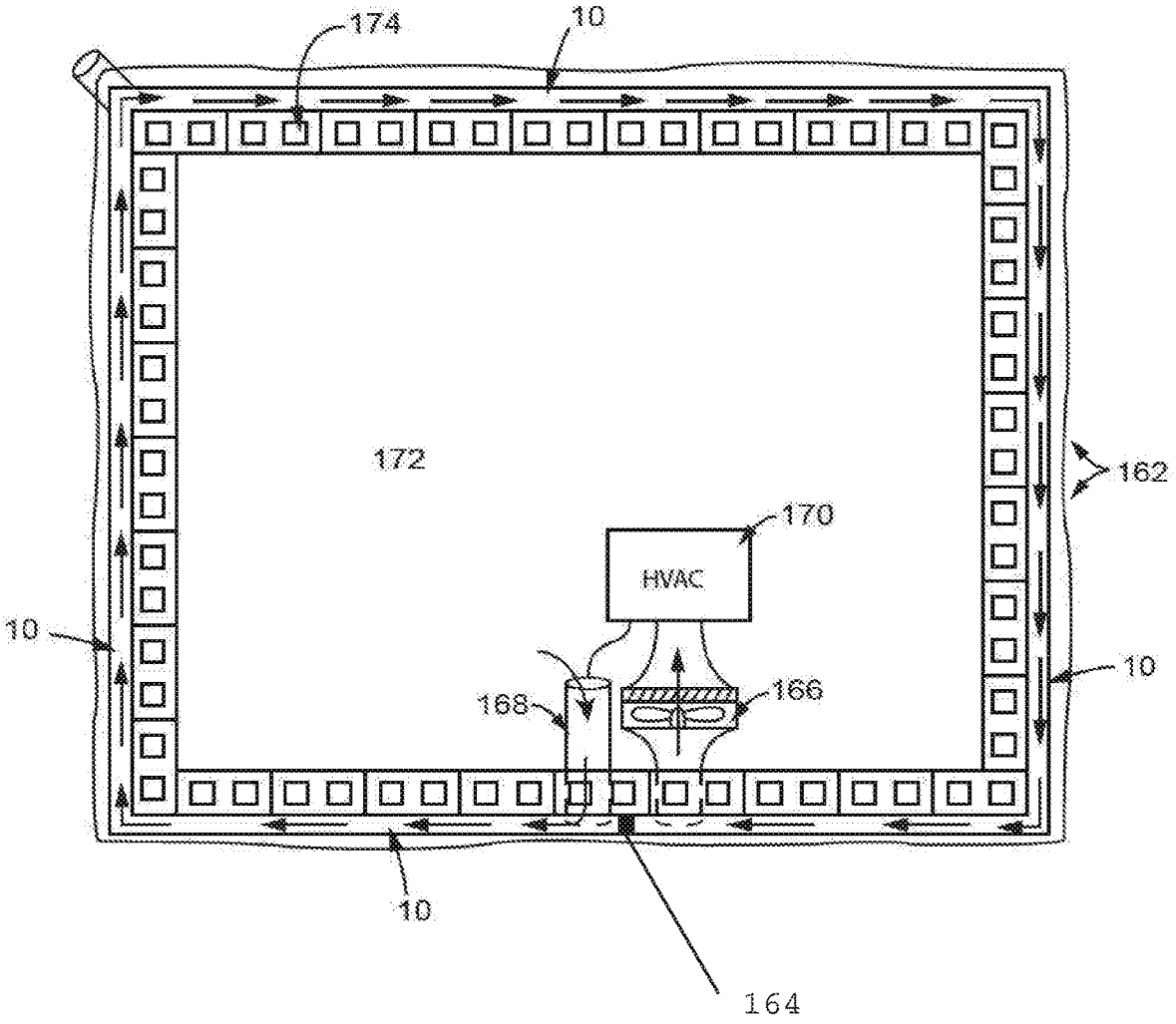
FIG. 16 is a top overhead diagram view showing that air can be circulated through the drain system to keep the foundation drier and/or to gather geothermal energy from the soil which is generally a more constant temperature. The one or more illustrated embodiments may keep a footer of a house foundation from freezing. The drain void exhaust could be circulated through an HVAC system or just filtered, conditioned, and pumped into the basement or crawl space of the home or not filtered or conditioned and pumped outside.

As illustrated in the diagrammatic view of FIG. 16, drain assemblies 10 may be positioned around the block or walls 174 of a basement 172 or crawl space of a house. The assemblies 10 are thus used as geothermal duct work, pumping air through the panels installed around foundations would add moisture and relatively fixed temperature air to a heating and air system that would be equipped with the proper, adequate filtration apparatus. As illustrated, air flow (represented by directional arrows) could flow within the assemblies 10 via blower 166 pulling air through an inlet 168 pulling in air into the HVAC 170. A separator/divider 164 may be provided between the air flows. Back fill is represented by 162. One or more methods for providing air circulation around a footer is thus provided. In a septic application, panels may be placed on their sides or upright.

These assemblies would be used to construct exterior forms for concrete poured walls and the external drain assemblies would remain in place as the waterproofing system, or they could be installed around existing foundation walls as a means of improving the waterproofing. They would not need to go all the way down to the footer and could just go part way down (1, 2 or 4.3', for example). These assemblies would stay in place on the outside of a poured wall or masonry unit [cinder block] wall foundation. These assemblies 10 would create an air space (3" for example) between the foundation wall/footer and the back filled soil or gravel so the wall drainage void could be easily accessed for inspection, testing, and cleaning by removing the top cap (which could be insulated) which would go around the perimeter of the waterproofed foundation from the base of the footer up to the grade level. The installed panels could act as an exterior form as well as the foundation walls waterproofing system. This system would allow water to pass into the drain panels on one side but not through the other impermeable side where the water could then run down into a drain pipe or trough to be carried away.

These systems thus provide a manner of using panels for use as forms for concrete poured walls and leaving the exterior panels in place against foundation walls, thereby eliminating the need for form stripping.

These systems further provide a manner of replacing French drain aspects of a septic system with a more accessible, maintainable system.

These systems provide a method of allowing air to be pumped through for producing geothermal air.

These systems are configured for reducing the drainage footprint of a property by keeping water onsite and adding permeable surface to that property.

These systems are further configured for providing foundation waterproofing and drainage by placing panels against foundation walls. This is provided by forming accessible airspace between the foundation wall and the backfill to allow, for example, a basement footer to be viewed from the grade level and preventing water leeching from the backfill from even touching the foundation wall's impermeable panel.

Other advantages would be that these waterproofing wall forms could be used to form the interior walls as well, then removed from the interior walls and reused on the next jobs exterior walls eliminating the need for cleaning and maintaining poured wall forms since they could be used the first time to form interior walls and then removed to be reused the next time to form exterior walls and be buried.

Figure 18B:
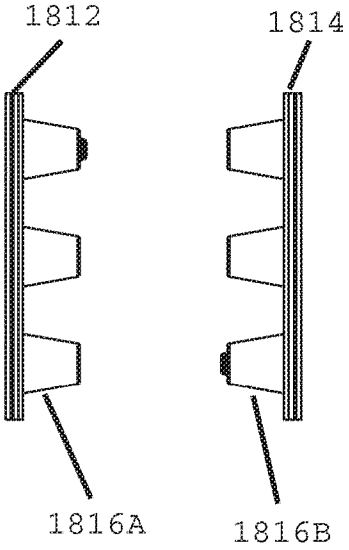
FIG. 18B is a front view of the exploded assembly of FIG. 18A.
Figure 18A:
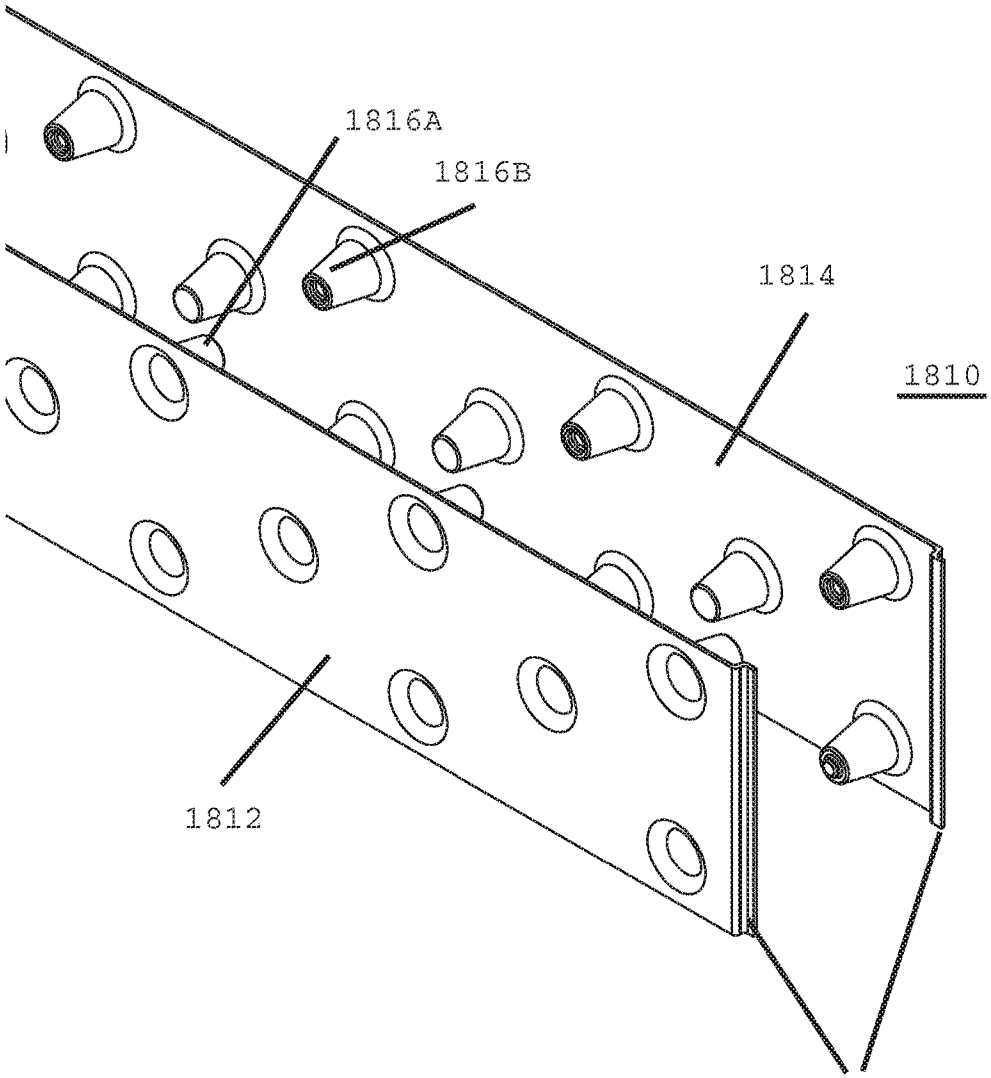
FIG. 18A is a perspective view of an exploded assembly where the panels are shown spaced apart according to one or more embodiments disclosed herein.
Figure 21:
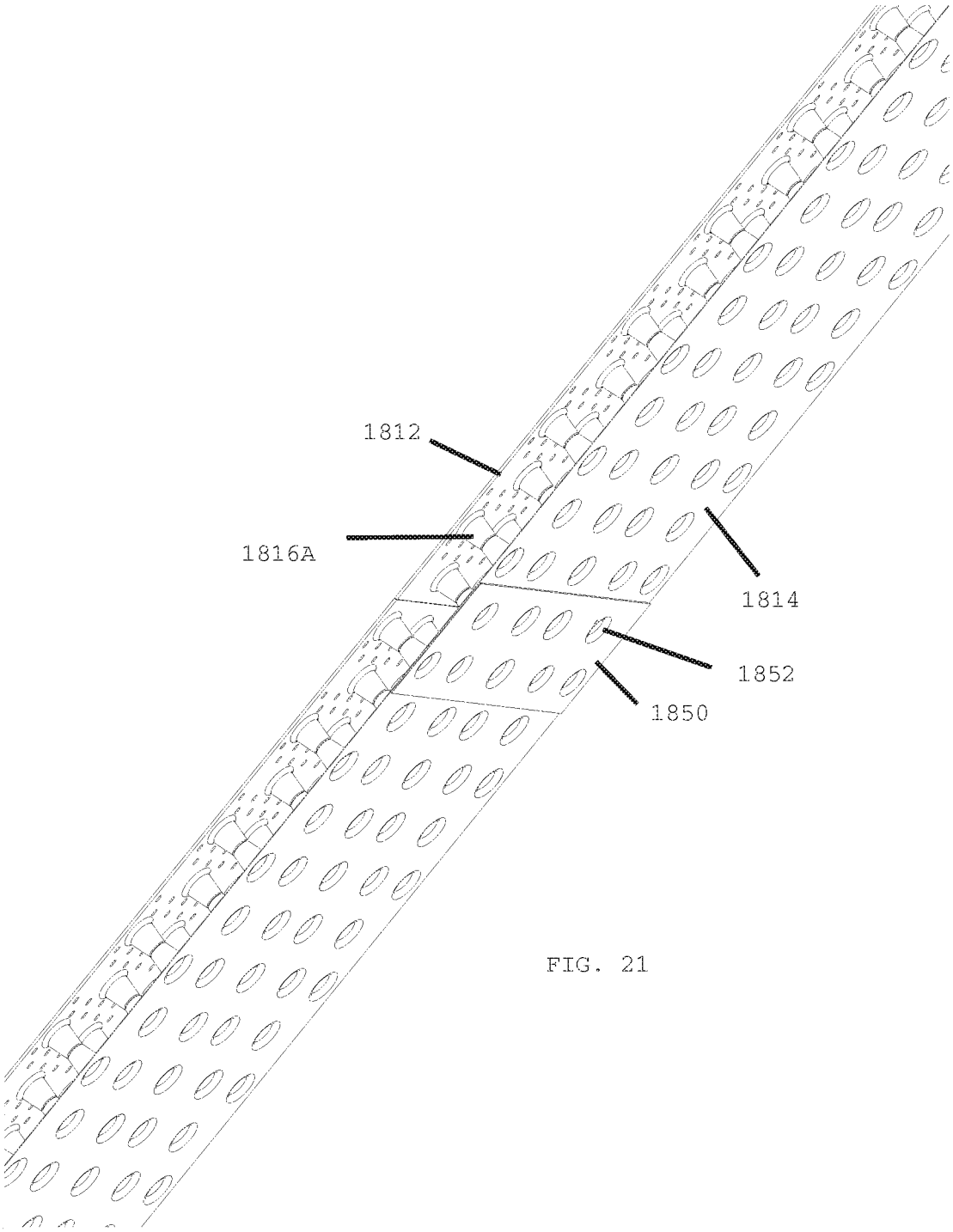
FIG. 21 illustrates a panel connecting member joining respective ends of a pair of panels.

FIGS. 18A, 18B, and 21 illustrate one or more embodiments of an assembly 1810. The assembly 1810 shares many characteristics with the assemblies disclosed herein. For example, assembly 1810 includes a panel 1812 and a panel 1814. The panels may be formed in any appropriate manner, including, for example, injection molding, vacuum molding, extruding, and the like. As illustrated, panel 1812 includes a support, which is illustrated as a cone 1816A. Panel 1814 includes a support, which is illustrated as cone 1816B. Collectively, the cones 1816A and 1816B are joined together by any appropriate mechanism in order to define the spacing between adjacent panels. Cones 1816A and 1816B may be joined together by nestable engagement where a protrusion is shown in FIG. 18B extending from, for example, the top left hand cone and is configured for being received by a recess that is best illustrated in any of the top row of cones 1816B of panel 1814. This also allows for easier assembly by aligning or aiding in alignment of the panels. Furthermore, a threaded fastener such as a screw could be extended through each cone 1816A and 1816B in order to secure opposing panels 1812 and 1814 together. Alternatively, glue or the like could be provided.

The panels 1814 and 1812 are configured such that the panels can be staggered relative to each other (meaning the ends of spaced-apart panels are not necessarily adjacent). When a desirable length of panel has been reached, the panel is cut with any appropriate cutting device. Hooks 1820 may he provided on an end of each panel for nestable engagement with a respective next hook of a next panel. A fastener 1822 is provided and illustrated in FIG. 20 to secure respective hooks 1820 to one another. Fastener 1822 may be configured for being slideably received by hooks 1820. A gasket or other sealing member may be provided about the intersection of hooks 1820 and fastener 1822.

Additionally, a row of panels may be staggered relative to a row above or beneath.

Figure 20:
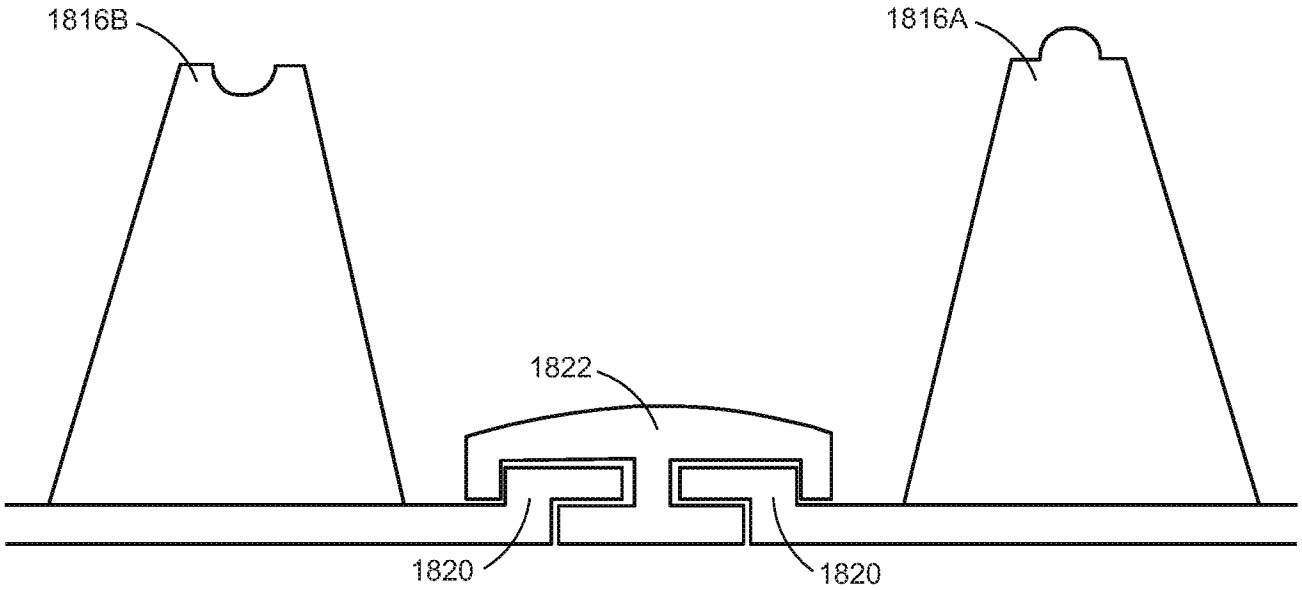
FIG. 20 illustrates a fastener for fastening respective hook assemblies of panels for forming a length thereof.

The panels 1812 and 1814 may further include a connecting "H" strip that can be fastened to the top surface thereof that allows the panel to be stacked and fastened or otherwise secured one on top of another when in an excavation as illustrated in FIG. 20. A nestable connection may be provided by cones or other extensions 1850 of one panel having a cone 1852 fitting into correspondingly formed cones 1816A or 1816B on the end of another panel as illustrated in FIG. 21. Alternatively, a splice reinforcement may be used or additionally used.

Figure 19B:
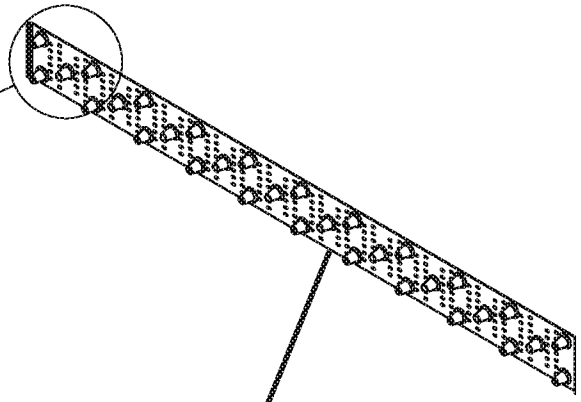
FIG. 19B is a perspective view of a panel of an assembly according to one or more embodiments disclosed herein.
Figure 19A:
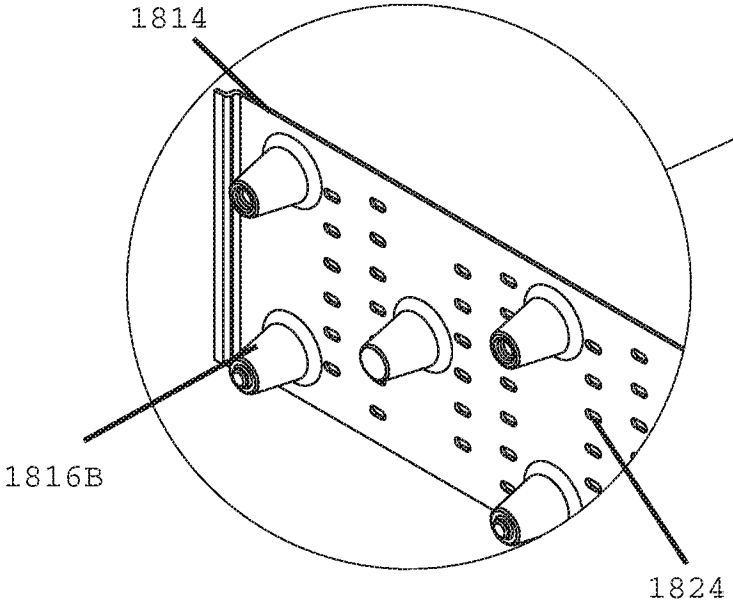
FIG. 19A is an enlarged perspective view of one panel of an assembly according to one or more embodiments disclosed herein.

As illustrated in FIGS. 19A and 19B, a panel 1814 may be provided that has one or more drainage apertures 1824 provided therein. The drainage apertures may be formed during a molding process or after manufacture with the use of a punch or CNC machine or similar.

In one or more embodiments, one panel 1812 may be provided, and a flat panel without any spacers/supports may be provided and joined as a curvable assembly or a panel (1812 or 1814) could be placed against a wall or other structure such that the wall or other structure surface would act as the second panel.

Figure 22B:
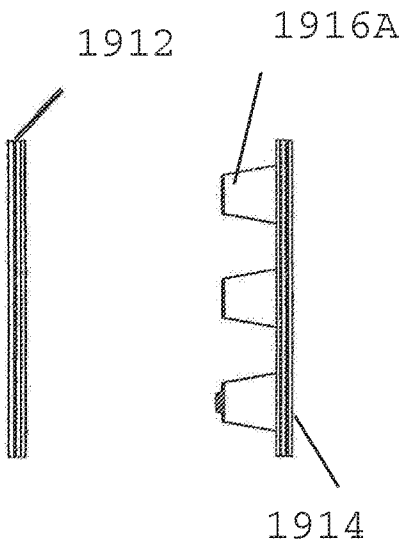
Figure 22A:
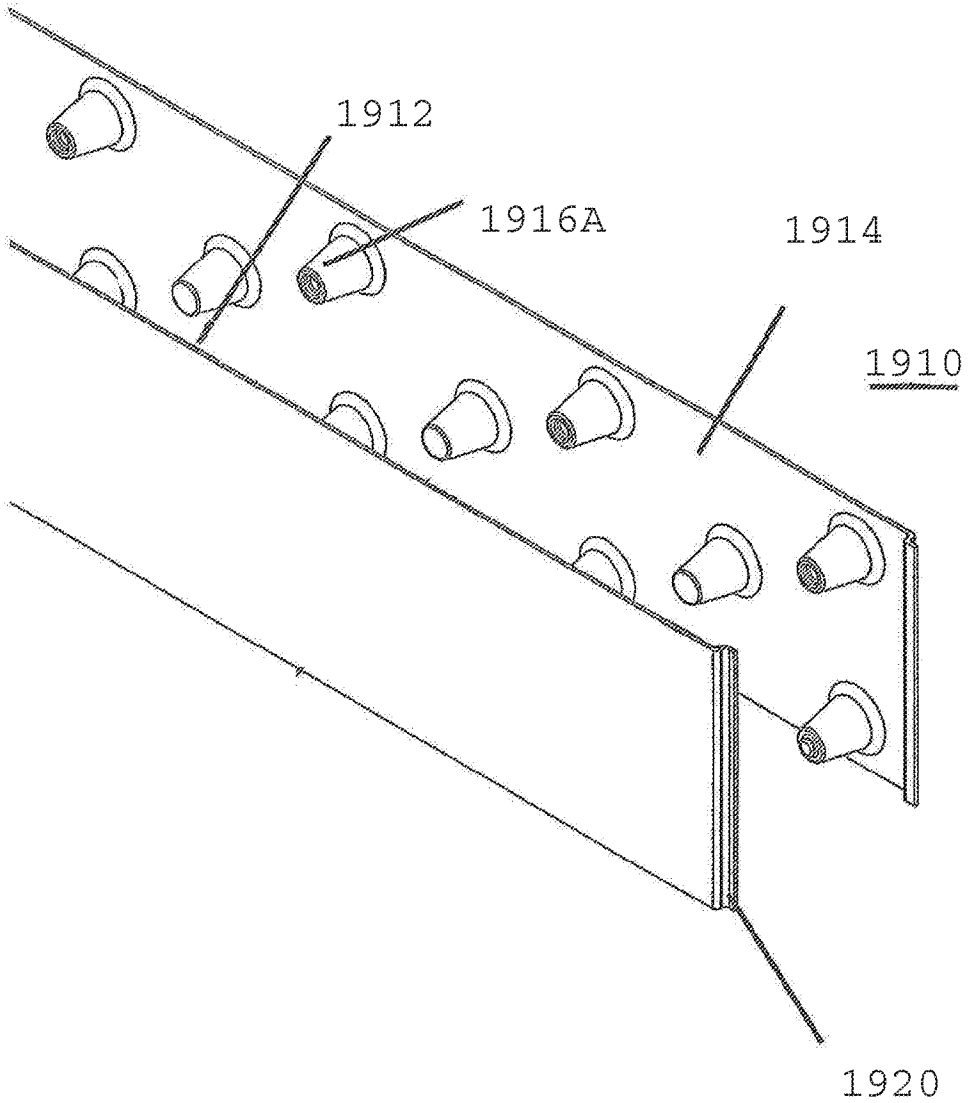

FIGS. 22A and 22B illustrate one or more embodiments of an assembly 1910. The assembly 1910 shares ma y characteristics with the assemblies disclosed herein, particularly the one or more embodiments depicted with reference number 1810. For example, assembly 1910 includes a panel 1912 and a panel 1914. The panels may be formed in any appropriate manner, including, for example, injection molding, vacuum molding, extruding, and the like. As illustrated, panel 1912 includes a support, which is illustrated as a cone or tapered support 1916A. The tapered support 1916A extends from the first panel 1912 to the second panel 1914, where the support 1916A tapers along the entire length of the support 1916A. A cap extends between the panels in some embodiments but is not shown in FIGS. 22A and 22B for ease of illustration purposes.

In one or more embodiments, assembly 1910 defines a bottom extending between a bottom portion of the first panel 1912 and a bottom portion of the second panel 1914. The bottom defines a pipe receiving area for receiving a pipe for directing channeled liquid flow.

In one or more embodiments, respective ends of the first panel 1912 and the second panel 1914 are configured for engaging a respective second drain assembly thereto.

In one or more embodiments, the cap is selectively engageable with the first panel 1912 and second panel 1914.

In one or more embodiments, a second drain assembly may be positioned into engagement with a top portion of the first panel and a top portion of the second panel.

In one or more embodiments, the drain assembly 1910 includes a filter material in a void defined in the drain assembly, and further including insulation under the cap.

In one or more embodiments, the second panel 1914 and the bottom is water impermeable. In other embodiments, the first panel 1912 and the second panel 1914 are water impermeable.

In one or more embodiments, the drainage assembly 1910 is configured for being in fluid engagement with a downspout of a gutter system.

In one or more embodiments, the drainage assembly 1910 includes at least one of a water level sensor, a moisture sensor, or a temperature sensor defined within a void of the drain assembly.

In one or more embodiments, the drainage assembly 1910 includes a locator wire.

In one or more embodiments, the void defines an area usable as a conduit for passing one of wires or hoses.

Features from one embodiment or aspect may be combined with features from any other embodiment or aspect in any appropriate combination. For example, any individual or collective features of method aspects or embodiments may be applied to apparatus, system, product, or component aspects of embodiments and vice versa.

While the embodiments have been described in connection with the various embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A drain assembly for being placed underground, comprising:

a first panel;

a second panel spaced-apart from the first panel, wherein a plurality of drainage apertures are defined through a surface of the second panel to allow flowthrough of water;

wherein the second panel is maintained in position relative to the first panel by the use of a plurality of distinct spacers extending from the first panel to the second panel into an interior defined therebetween, wherein a cap is selectively engageable with the first and second panels, the cap being removable to allow access into an interior of the drain assembly, wherein a drainage pipe is positioned below the first and second panels such that at least one of the first panel and the second panel contacts the drainage pipe, wherein the drainage pipe defines a plurality of apertures extending through a surface thereof, wherein the drainage pipe is in fluid communication with the interior defined between the first and second panels such that fluid passing therein flows into the drainage pipe, whereby the first panel is positioned proximal to a foundation wall of a structure.

2. The drain assembly according to claim 1, wherein respective ends of the first panel and the second panel are configured for engaging a respective second drain assembly thereto.

3. The drain assembly according to claim 1, wherein, a second assembly may be positioned into engagement with a top portion of the first panel and a top portion of the second panel.

4. The drain assembly according to claim 1, further including a filter material in an interior defined in the drain assembly between the first panel and the second panel.

5. The drain assembly according to claim 1, wherein the drain assembly is fluidly engaged with a downspout of a gutter system.

6. A method for providing drainage to an area, comprising:

providing a drain assembly that comprises:

a first panel;

a second panel spaced-apart from the first panel, wherein a plurality of drainage apertures are defined through a surface of the second panel to allow flowthrough of water;

wherein the second panel is maintained in position relative to the first panel by the use of a plurality of distinct spacers extending from the first panel to the second panel into an interior defined therebetween, wherein a cap is selectively engageable with the first and second panels, the cap being removable to allow access into an interior of the drain assembly, wherein a drainage pipe is positioned below the first and second panels such that at least one of the first panel and the second panel contacts the drainage pipe, wherein the drainage pipe defines a plurality of apertures extending through a surface thereof, wherein the drainage pipe is in fluid communication with the interior defined between the first and second panels such that fluid passing therein flows into the drainage pipe, whereby, in operation, the first panel is positioned proximal to a foundation wall of a structure, forming a void in the ground;

placing the assembly into the void; and filling the volume of the void outside of the drain assembly.

7. The method according to claim 6, further including providing a filter fabric around an exterior of the assembly before filling the volume of the void outside of the drain assembly.

8. The method according to claim 7, further attaching a second assembly to an end of the first assembly to create a length of attached assemblies.

9. The method according to claim 7, further including one of attaching end caps to an end of an assembly, or attaching adapters for coupling a pipe to the drain assembly.

10. The method according to claim 7, further including attaching a second assembly to a top of the first assembly to create a height of attached assemblies.

11. The method according to claim 7, wherein the first panel defines a plurality of drainage apertures.

12. The drain assembly according to claim 1, wherein the cap defines drainage apertures for capturing water flow therethrough and allowing water to enter into the drain assembly.

* * * * *